United States Patent [19]

Tarassoff

[11] Patent Number: 4,699,064

[45] Date of Patent: Oct. 13, 1987

[54] DEVICE FOR DRIVING CARS OR CHAIRS OF A GONDOLA-LIFT OR CHAIR-LIFT IN STATIONS

[75] Inventor: Serge Tarassoff, Seyssinet-Pariset, France

[73] Assignee: Pomagalski S.A., Fontaine, France

[21] Appl. No.: 755,470

[22] Filed: Jul. 16, 1985

[30] Foreign Application Priority Data

Jul. 26, 1984 [FR] France ..... 8412042

[51] Int. Cl.[4] ..... B61B 10/00; B61B 12/10

[52] U.S. Cl. ..... 104/163; 104/173.2

[58] Field of Search ..... 104/162, 163, 173 R, 104/173 ST, 189, 190

[56] References Cited

U.S. PATENT DOCUMENTS

| | | | |
|---|---|---|---|
| 3,875,867 | 4/1975 | Geyer | 104/173 ST |
| 4,050,385 | 9/1977 | Gurr et al. | 104/173 ST |
| 4,563,955 | 1/1986 | Tarassoff | 104/173 ST X |

FOREIGN PATENT DOCUMENTS

| | | | |
|---|---|---|---|
| 0114129 | 7/1984 | European Pat. Off. . | |
| 323535 | 8/1920 | Fed. Rep. of Germany | 104/163 |
| 2060030 | 6/1972 | Fed. Rep. of Germany . | |
| 1084185 | 1/1955 | France . | |
| 1401291 | 4/1965 | France . | |
| 2050964 | 4/1971 | France . | |
| 2504480 | 10/1982 | France . | |
| 340856 | 10/1959 | Switzerland . | |

*Primary Examiner*—Robert B. Reeves
*Assistant Examiner*—John G. Pido
*Attorney, Agent, or Firm*—Parkhurst & Oliff

[57] ABSTRACT

A preferred embodiment for a detachable gondola lift is disclosed in which carraiges on a closed circuit are detached from the circuit upon entering an end station and coupled to a semi-circular section before being recoupled onto the circuit upon exiting the end station. The semi-circular section has a drive wheel with a first drive mechanism on its periphery for driving the carriages over the semi-circular section. The first drive mechanism is located at regular intervals and driven at a predetermined first speed to impose a regular flow rate to the carriages leaving the semi-circular section and a regular distribution of carriages on the circuit. The semi-circular section also includes a second drive mechanism for imparting a slightly different speed to the carriages from that imposed by the drive wheel. One of the drive means has priority to impose a predetermined flow rate to the carriages leaving the semi-circular section. In another embodiment, the semi-circular section is divided into two straight rails and a circular rail on the drive wheel. In addition, the invention contemplates using two coaxial wheels: a drive wheel with pins and a support wheel. The pins may be fixed or retractable.

7 Claims, 15 Drawing Figures

DEVICE FOR DRIVING CARS OR CHAIRS OF A GONDOLA-LIFT OR CHAIR-LIFT IN STATIONS

BACKGROUND OF THE INVENTION

The invention relates to an aerial ropeway transport installation running continuously in a closed circuit in which the cars are detached from the rope as they enter the station and travel through the station on a half-loop circuit linking the up and down tracks before being reattached to the rope as they leave the station.

The U.S. patent application No. 570,687, filed on Jan. 13, 1984, now U.S. Pat. No. 4,441,430; describes an installation of the kind mentioned, which uses a drive chain, extending in a closed loop along the circuit on which the cars or chairs detached from the rope travel through the stations. The flow over the curved sections of the circuit is irregular and the in-station driving device is costly, noisy and complicated.

The object of the present invention is to simplify the device for driving the cars through the station, making the curves easier to negotiate while keeping the advantages of the previous system.

SUMMARY OF THE INVENTION

The circuit on which the cars run through the station according to the invention comprises a circular section, notably semicircular in shape, fitted with a positive carriage driving device comprising a drive wheel with a vertical axis, coinciding with the drive axis of said semicircle, the wheel being driven in rotation and having on its periphery means for driving the carriages over said semi-circular section.

In the curved part of the circuit, driving is performed by a drive wheel with a vertical shaft, driven in rotation by a motor or by a power connection on the rope or the motor mechanism of the latter. The diameter of this drive wheel preferably corresponds to the gauge of the track, to allow connection by means of straight rails forming the loading and unloading platforms. The drive on the straight sections is performed in a classic manner, by gravity, chain, friction wheels or the like.

Driving by means of a wheel on the curved end section is particularly suitable for providing a flow regulating device, of the kind described in the previously mentioned patent application, which automatically maintains a regular interval between the cars all the time the installation is operating. According to one embodiment of the invention, the straight section driving device, for example the friction drive sheaves, is extended over a part of the curved section, to provide a second drive system, for example at a slightly lower or higher speed than that of the drive wheel. Depending on the position of the car as it enters this part of the curved section, it is driven by one or other of the driving means to catch up any lag if it is behind or to take up any advance if it is ahead. The operation of a flow regulator of this kind is described in the above-mentioned patent application which should be referred to for further details on such flow regulators.

The flow regulating curved section may involve slow driving by gravity or with the car being temporarily stopped, the drive wheel taking the car up more or less quickly depending on the position of the latter.

The second drive means associated with the flow regulating section may, according to an alternative embodiment of the invention, be a second wheel coaxial to the first one and turning at a slightly different speed.

Driving by one of these wheels has priority using, for example, single-direction drive pins on one of the wheels.

The installation may be of the single or double-rope type, the cars or chairs, detached from the rope in the station, running on a rail, which may extend along the whole track, particularly around the drive wheel or over parts of this track, particularly the straight parts. In the latter case, the drive wheel is arranged in such a way as to support the cars over the curved section and the upper face of the wheel forms a circular rail, in which the roller or rollers of the carriages supporting the cars engage, for example by means of a sloping connecting section. Any other method of supporting or connecting may also be used.

The rail may be borne by a support wheel, coaxial with the drive wheel, and the two wheels may be driven in rotation at slightly different speeds to achieve flow regulation.

The rate at which the cars run is determined by the speed of rotation of the flow regulating wheel and by the spacing of the drive means, in this instance the pins fitted at intervals on the circumference of the wheel. The possibilities of varying the speed at which the cars run are limited and to multiply the carrying capacity of the installation for example twofold, it is sufficient to multiply the number of active pins. Some of the pins, one out of two or any other proportion, are of the retractable type. Movement of the pins from the active position to the retracted or inactive position may be controlled by any operating means, particularly by a movable cam actuating the heel of a pin to move it to the retracted position. Only the pins fitted with a heel, in this instance one pin out of two, are thus moved to the inactive position when they pass in front of the cam placed in the control position. Similar or equivalent systems may also be used.

BRIEF DESCRIPTION OF THE DRAWINGS

Other advantages and characteristics will become more clearly apparent from the description which follows of the various embodiments of the invention, given as examples only and represented in the accompanying drawings, in which.

DETAILED DESCRIPTION OF THE PREFERRED EMBODIMENTS

Figure 1:
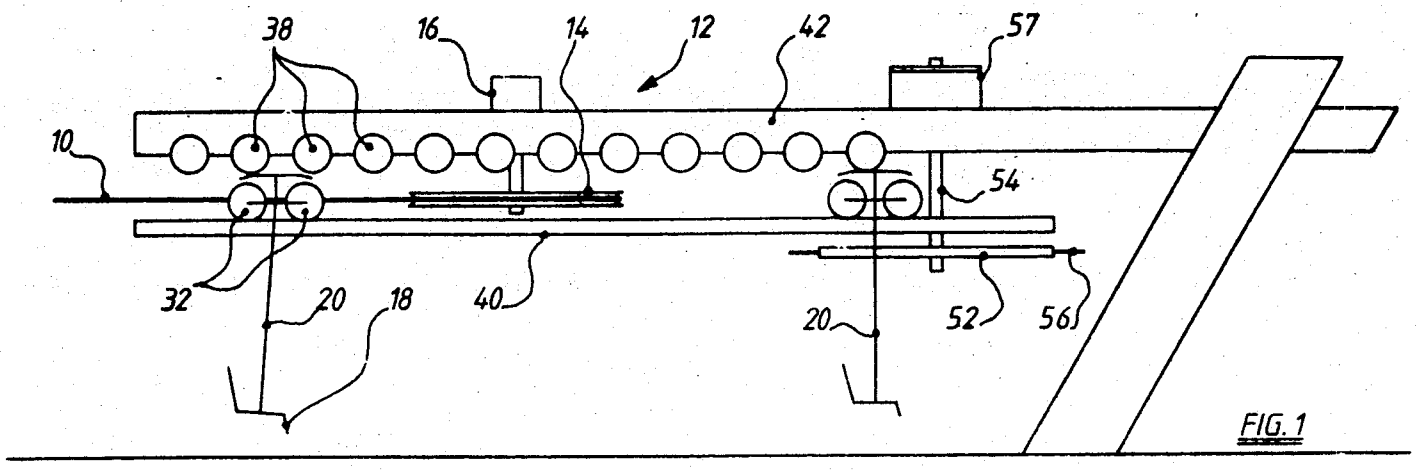
FIG. 1 is a schematic elevational view of a station according to the invention.

In the figures, the same reference numbers are used to designate identical or similar parts.

In the figures, an aerial rope 10 of a single-rope chair-lift which could be a gondola-lift or a similar single or double-rope tramway, passes through an end station 12 on an end wheel 14 driven in rotation by a motor 16. The chairs 18 are fixed by a hanger arm 20 to a carriage 22 bearing a grip 24 coupling it to the rope 10. A spring 26 urges the grip 24 into the rope clamping position, opening being controlled by a lever 28 cooperating with a fixed ramp 30. The carriage 22 has rollers 32 and positioning sheaves 34 and a drive plate 36 cooperating with friction drive sheaves 38 fitted with tires. A grip of this kind is for example described in the U.S. Pat. No. 4,441,430 which should be referred to advantageously.

At the entry to the station, a transfer rail 40 on which the rollers 32 engage is disposed parallel to the rope 10. Simultaneously, the lever 28 controlling opening of the grip 24 catches on the ramp 30 to open the grip 24 and uncouple the carriage 22 from the rope 10. A slight relative movement of the carriage 22 in relation to the rope 10 releases the latter from the grip 24. A battery of friction drive sheaves 38 with tires, supported by an arm 42 parallel to the rail 40, cooperate with the plate 36 of the carriage 22 to drive the latter. The friction drive sheaves 38 are driven in rotation by any appropriate means (not shown), the first sheaves of the battery turning at the speed of the rope 10 to synchronize the movement of the carriage 22 whereas the following sheaves 38 decelerate the carriage 22 detached from the rope 10 and running on the rail 40. The rail 40 extends in a half-loop in the station to join the other wire of the rope 10 which constitutes the track of the chair-lift passing infront of a loading area 44 if the station 12 is a loading station. It is obvious that this station can be an unloading station or have both a platform for loading and a platform for unloading passengers, particularly skiers.

Figure 2:
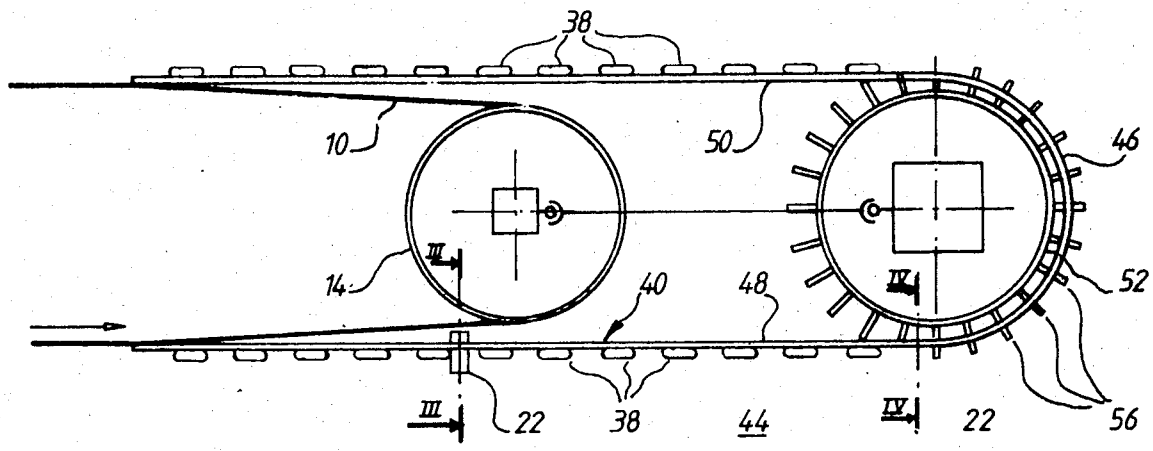
FIG. 2 is a plan view of the station according to FIG. 1.
Figure 3:
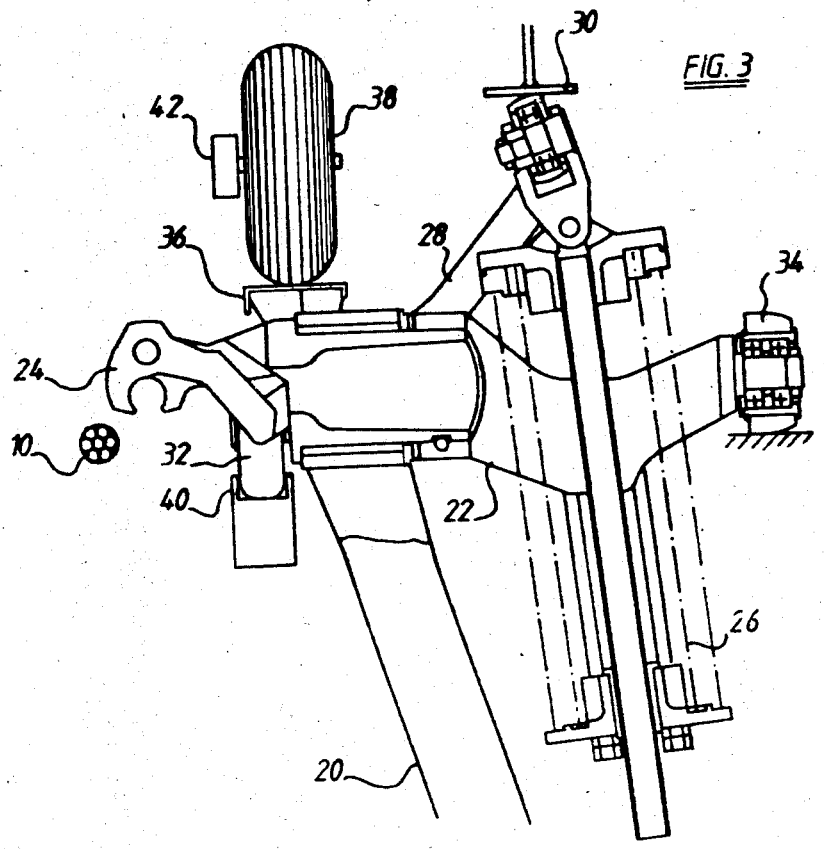
FIGS. 3 and 4 are cross-sections, respectively along the lines III—III and IV—IV of FIG. 2.
Figure 4:
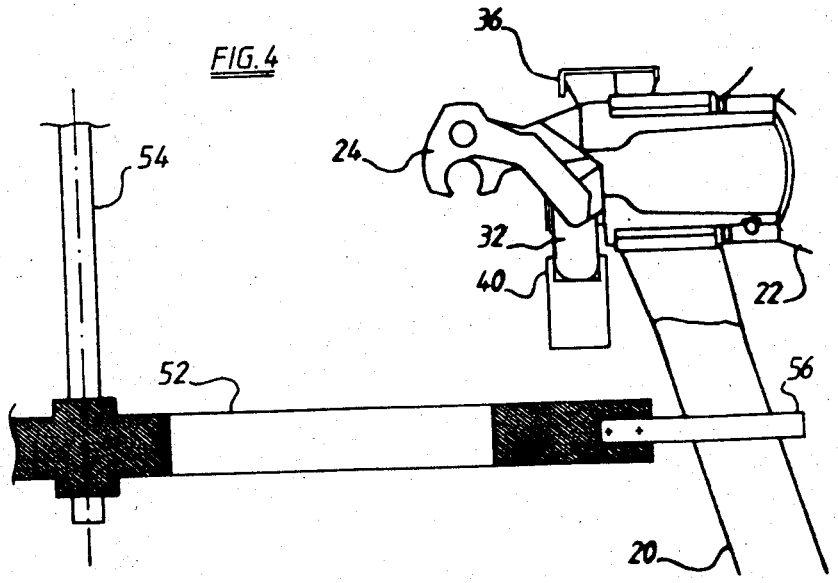

The half-loop circuit, formed by the rail 40, comprises a semicircular end section 46, to which two straight sections 48, 50 are connected, each one aligned with one of the tracks, up or down, of the line. The semi-circular section 46 has associated with it a drive wheel 52 with a vertical axis 54 driving the carriages 22 over this section. The diameter of the drive wheel 52 is slightly smaller than that of the semi-circular trajectory and drive pins protrude radially from the drive wheel 52 to cooperate with the carriage 22 running over the section 46. The drive wheel 52 is driven in rotation by a motor 57 or by any other appropriate means at the speed at which the chairs or cars, henceforth called cars, run in the station. On the straight sections 48, 50, the carriages 22 are driven by the friction drive sheaves 38 fitted along these sections. In the embodiment represented in FIG. 2, the carriages 22 are driven positively all the way through the station, by the friction drive sheaves 38 over the section 48, by the drive wheel 52 over the curved section 46, and by the friction drive sheaves 38 over the outgoing section 50. The last friction drive sheaves 38 of the circuit constitute a device to accelerate the carriages 22 to synchronize the speeds of the carriages 22 and of the rope 10 before recoupling by closing of the grip 24 on the rope 10. Driving by means of the drive wheel 52 is particularly smooth and silent and allows the instation running system to be greatly simplified. It is clear that these advantages are kept when the straight sections 48, 50 are fitted with other drive systems, by gravity, forced drive or a combination thereof.

Figure 5:
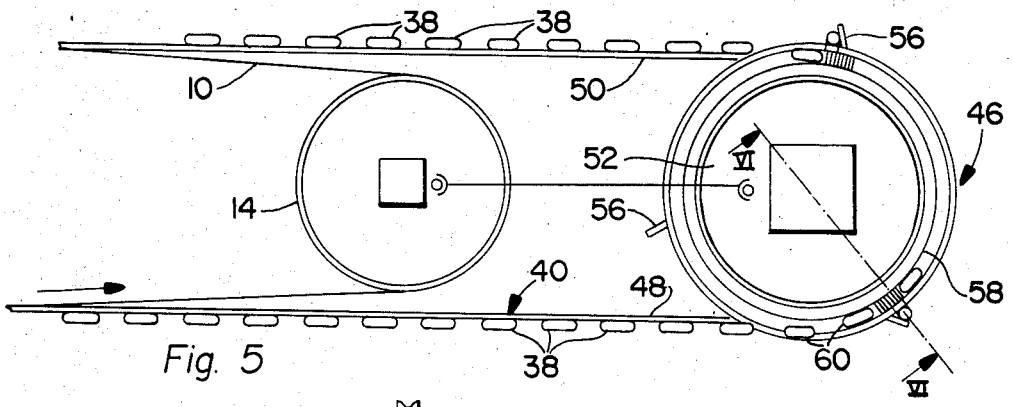
FIG. 5 is a similar view to that of FIG. 2, illustrating an alternative embodiment.
Figure 6:
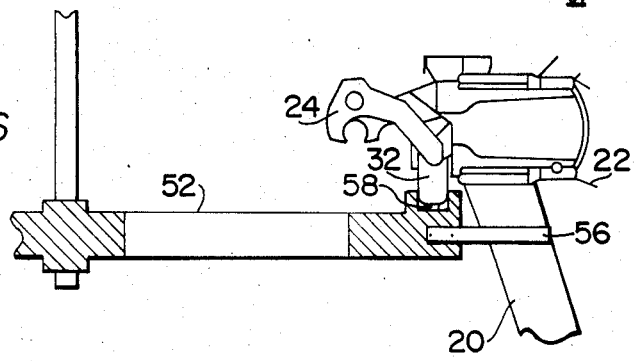
FIG. 6 is an enlarged scale cross-section along the line VI—VI of FIG. 5.

The running of the carriages 22 over the semi-circular section 46 can be improved by interrupting the rail 40, in the way shown in FIGS. 5 and 6, over this section 46 and by fitting on the upper face of the drive wheel 52 a circular peripheral rail 58 which connects with the ends of the rail 40. In the case of a U-shaped rail 58, connection is by means of a sloping pin (not shown) which inserts or extracts the rollers 32 of the rail 58. Other connection means, adapted to the shape of the rails 40, 58 may be used. It is clear that running of the rollers 32 on the curved rail 58 is nil or very slight, which makes for easy running of the carriages 22 over the curved section 46.

In FIGS. 5 and 6, friction drive sheaves 60, similar to the sheaves 38 of the straight sections 48, 50, are arranged on a sector of the drive wheel 52, in this instance, but not necessarily, at the entry point to the latter. The linear speed of the friction drive sheaves 60 is slightly lower than that of the drive wheel 52 and the assembly is designed in such a way that a car which is too far ahead is driven by the friction drive sheaves 60 over the section entering the drive wheel 52 and taken up at the end of the sector by the pin 56, whereas a car which is behind is taken over directly at the entry by the pin 56, driving it at a higher speed to catch up its lag. A wheel free from the friction drive enables high speed movement. The rollers 32 of the carriage 22 run on the rail 58 when slow driving takes place. The operating principle of this kind of flow regulator is described in the previously mentioned patent application, certain features of which are applicable to the present system.

Figure 7:
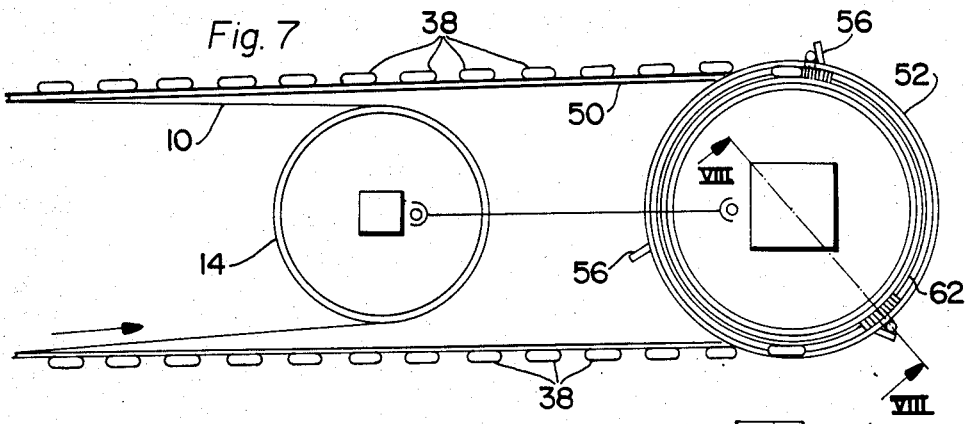
FIGS. 7 and 8 are similar views to those of FIGS. 5 and 6, showing another alternative embodiment.
Figure 8:
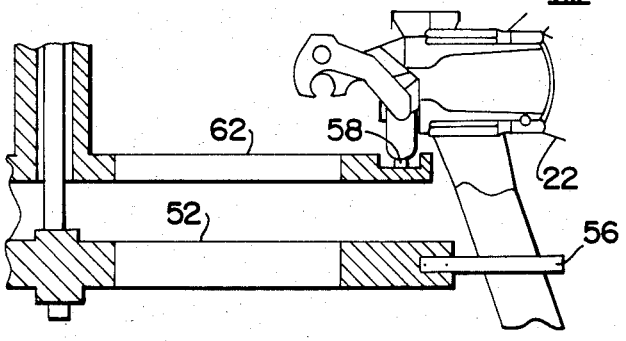

FIGS. 7 and 8 illustrate an alternative embodiment of the invention, using two coaxial wheels, the drive wheel 52 with pins 56, and a support wheel 62, having on its periphery the rail 58 which receives the rollers 32 of the carriage 22. In a non flow regulating system, the drive wheel 52 and support wheel 62; turn in synchronism, flow regulation being possible by making the support wheel 62 turn at a lower speed to impose the slow running speed. When the carriage 22 is taken over by the pins 56, the rollers 32 run on the rail 58 of the support wheel 62.

Figure 9:
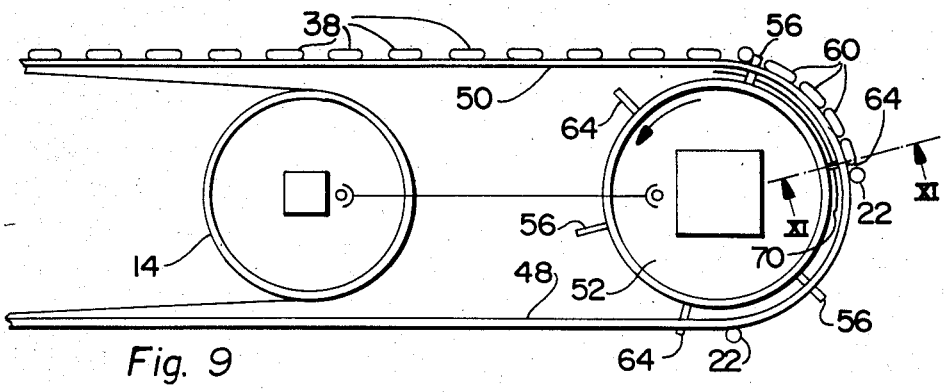
FIGS. 9 and 10 are similar views to that of FIG. 2, illustrating, at two successive moments, an alternative embodiment.
Figure 10:
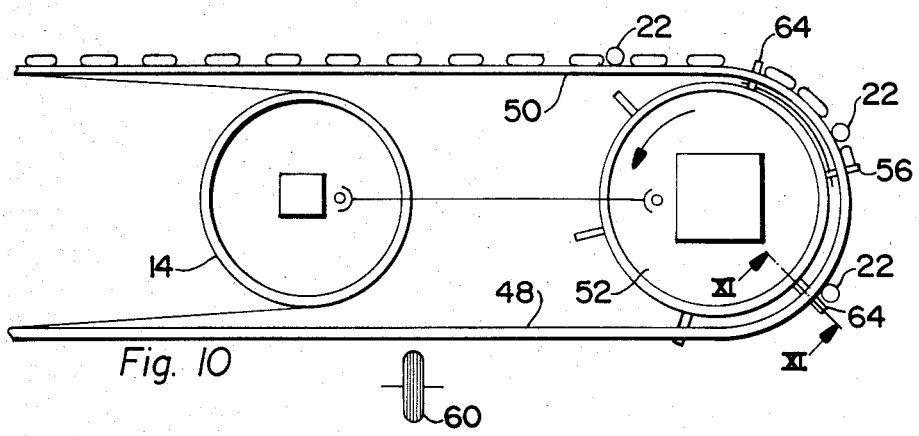

Driving over the straight sections 48, 50 may be performed by any appropriate means, particularly by gravity, FIGS. 9 and 10 showing as an example an installation driven by gravity over the incoming section 48 and by friction drive sheaves 38 over the outgoing section 50. A part of the section 48 may be fitted with friction wheels or other drive means, whereas the section 50 may be partially driven by gravity. Specialists will easily be able to design other operating combinations. In FIGS. 9 and 10, the flow regulating sector of the drive wheel 52 is disposed on the exit side of the semi-circular section 46. A carriage 22 reaching this regulating section either ahead of or behind the predetermined flow schedule is automatically repositioned by the differential speed between the drive wheel 52 and the friction drive sheaves 60.

Figure 11:
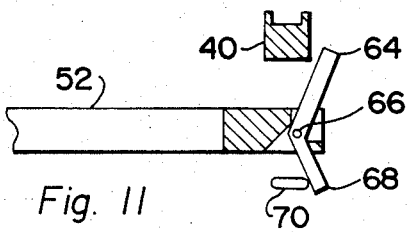
FIGS. 11 and 12 are cross-sections along the lines XI—XI of FIG. 9 and XII—XII of FIG. 10.
Figure 12:
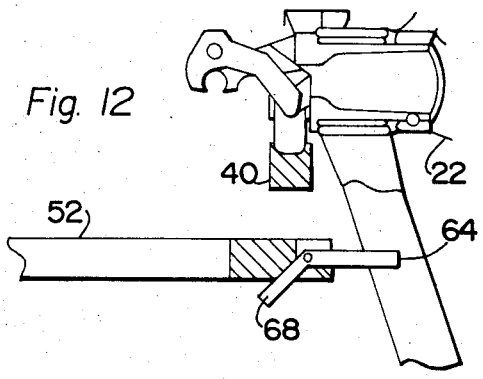

The drive wheel 52 includes fixed pins 56, in this instance three, represented by the bold marks, and an equal or different number of retractable pins 64, represented in detail in FIGS. 11 and 12. The fixed 56 and retractable 64 pins are alternated, the proportion of fixed and retractable pins not necessarily being equal. Each retractable pin 64 is fitted pivotally on a spindle 66 and has a heel 68, cooperating with a cam 70, extending along the regulating section or a part thereof. The cam 70 is itself movable or retractable into a position where it does not engage with the heels 68. When the cam 70 is retracted, the retractable pins 64 remain in the active position and behave like fixed pins, the flow regulating drive wheel 52 then having six pins. In the active position of the cam 70, the retractable pins 64 are raised so as not to cooperate with the carriages 22 (FIG. 11) and the flow regulating drive wheel 52 comprises three active pins providing a carriage flowrate reduced by one half. It is clear that the system for changing the flowrate and any particular system described with reference to one of the figures is applicable or can be combined with other systems according to the invention, in particular illustrated by other figures. The means of retracting the pins 64 may be different and involve one pin out of three or any other proportion.

The operation of the flow regulator by means of the retractable pins 64 can be seen from FIGS. 9 and 10. At the moment represented in FIG. 9, a first carriage 22 driven by a fixed pin 56 has reached the outgoing end of the semi-circular section 46, whereas another carriage 22 is entering this section 46 ahead of schedule and is going to be taken up by one of the retractable pins 64 in the active drive position. A third carriage 22, located between the other two, has just entered the flow regulating section, the corresponding retractable pin 64 having just been raised to the inactive position by the cam 70. This third carriage 22 is driven at slow speed by the friction drive sheaves 60. A moment later, illustrated in FIG. 10, the first carriage 22 is engaged on the straight section 50, whereas the third carriage 22 is going to be taken up by the fixed pin 56 and the last carriage 22, driven by a retractable pin 64, is approaching the flow regulating section where its pin 64 will be pivoted into the retracted position by the cam 70. It is obviously possible to retract the retractable pins 64 permanently or to remove them, the only drawback being that carriages which are too far ahead will be temporarily stopped on entering the curved section. All stopping is avoided by fitting a large number of retractable pins 64.

Figure 13:
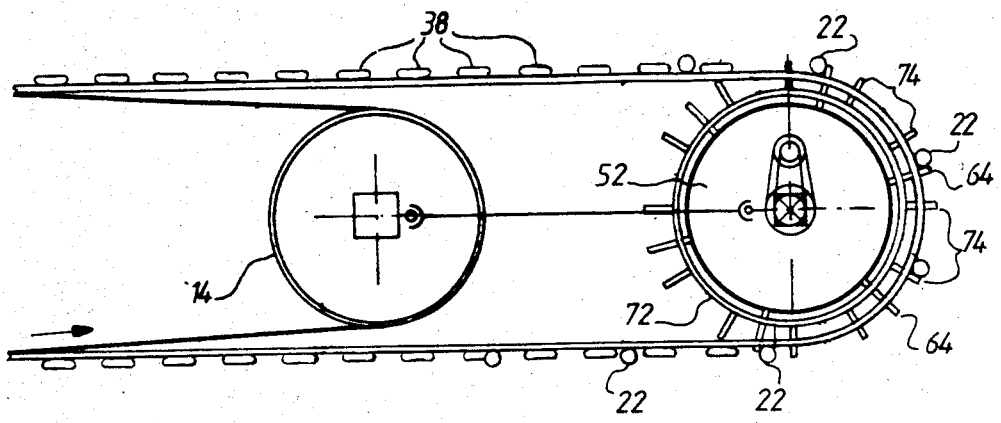
FIGS. 13 and 14, similar to FIGS. 5 and 6, show another alternative embodiment.
Figure 14:
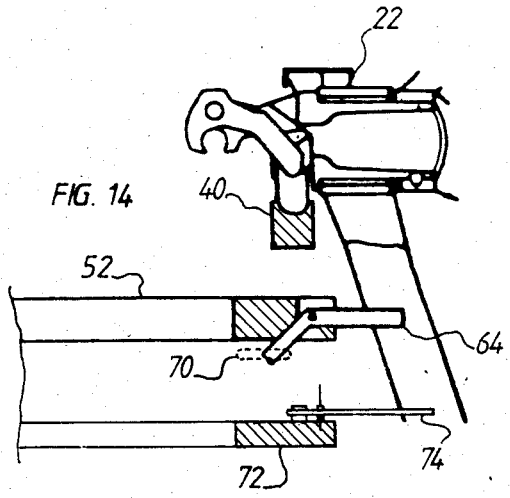
Figure 15:
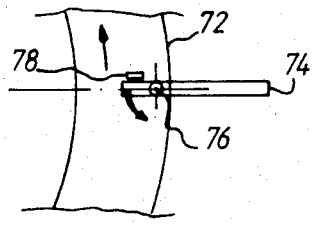
FIG. 15 is a detailed view of a drive pin.

FIGS. 13 to 15 represent another alternative embodiment in which the semi-circular section 46 is fitted with two coaxial drive wheels, a first drive wheel 52 fitted with drive pins 64, some of which can be retracted in the manner described above by the action of a cam 70 represented by the dashed line in FIG. 14, and a second drive wheel 72, fitted with single-direction drive pins 74. The pins 74 are articulated on a vertical spindle 76 and cooperate with a stop 78 to provide positive drive in the trigonometric rotation direction and retraction of the pins 74 in the opposite direction. The second drive wheel 72 provides slow speed non priority drive, whereas the first drive wheel 52, which turns at a higher speed, determines the flowrate of the carriages 22, a carriage 22 driven by a pin 64 at a higher speed not being prevented from passing by the pins 74. Flow regulation is carried out over the whole curved section 46 and by fitting a large number of pins 74 the cars are practically never at a standstill. It is pointless giving a detailed account of the operation of this system which is apparent from the above description.

I claim:

1. An aerial ropeway transport installation running continuously in a closed circuit, comprising an up track and a down track connecting two end stations, loads running on the circuit, carriages supporting the loads having detachable grips able to be coupled to the rope on the circuit and detached on entering a station, a half-loop circuit joining the up and down tracks, on which the carriages run in at least one of said stations before being recoupled on the rope on leaving that station, said half-loop circuit comprising a semi-circular section having a device to positively drive the carriages, comprising a drive wheel with a vertical axis coinciding with the axis of said semi-circular section, the drive wheel being driven in rotation and bearing on its periphery first means for driving the carriages over said semi-circular section, said first drive means being located at regular intervals on said periphery and driven at a predetermined first speed to impose a regular flow rate to the loads leaving the semi-circular section and a regular distribution of the loads on the circuit, said semicircular section equipped with said drive wheel comprising at least over a part of the section a second drive means for imparting to the carriages a slightly different second speed from that imposed by the drive wheel, one of the first and second drive means having priority to impose a predetermined flowrate of the loads leaving the semi-circular section.

2. The installation according to claim 1, wherein the carriages supporting the loads have a friction track and said half-loop circuit has friction drive sheaves cooperating with said friction track, at least one of said sheaves being located on said semi-circular section to form said second drive means cooperating with the drive wheel to impose a predetermined load flowrate.

3. The installation according to claim 1, wherein said semi-circular section comprises supporting means on the periphery of said drive wheel for supporting the carriages.

4. The installation according to claim 3, wherein the carriages have running rollers, said supporting means comprising a circular rail, on which said rollers engage during the passage over the semi-circular section.

5. The installation according to claim 1, wherein the carriages have running rollers, said semi-circular section including a rotating support wheel arranged coaxially with said drive wheel, said rotating support wheel having on its periphery a rail on which said rollers run.

6. The installation according to claim 1, wherein the drive wheel has on its perhiphery fixed drive pins constituting said first drive means, whose regular spacing determines the flowrate of the loads, and retractable pins retracting over a regulating part of the semicircular section, said regulating part of the semi-circular section having said second drive means.

7. The installation according to claim 1, wherein the semi-circular section has a rail on which the carriages supporting the loads run, two drive wheels each having one of said first and second drive means for driving the carriages over said semi-circular section, the driving speeds of the two drive wheels being slightly different and the drive means of one of the two drive wheels having priority over the drive means of the other wheel to impose a regular flowrate of the loads leaving the semi-circular section, imposed by the one drive wheel fitted with the priority drive means.

* * * * *